United States Patent [19]

Hasegawa et al.

[11] Patent Number: 4,877,678

[45] Date of Patent: Oct. 31, 1989

[54] SHEET MATERIAL FOR INK-JET PRINTING

[75] Inventors: Masamitsu Hasegawa; Satoshi Tamura; Takashi Wakashima; Isao Sugiyama, all of Saitama, Japan

[73] Assignee: Shin-Etsu Polymer Co., Ltd., Tokyo, Japan

[21] Appl. No.: 198,398

[22] Filed: May 25, 1988

[30] Foreign Application Priority Data

Jun. 5, 1987 [JP] Japan ..... 62-140897

[51] Int. Cl.[4] ..... B41M 5/00

[52] U.S. Cl. ..... 428/216; 428/215; 428/327; 428/328; 428/330; 428/331; 428/335; 428/336; 428/412; 428/423.1; 428/447; 428/474.4; 428/478.2; 428/480; 428/500; 428/521; 428/522; 428/532; 428/195

[58] Field of Search ..... 428/212, 207, 211, 215, 428/216, 304.4, 316.6, 317.9, 323, 327–331, 334–336, 195, 480, 500, 521, 522, 532, 412, 423.1, 447, 474.4, 478.2

[56] References Cited

U.S. PATENT DOCUMENTS 4,460,637 7/1984 Miyamoto et al. ..... 428/212

*Primary Examiner*—Ellis P. Robinson
*Assistant Examiner*—P. R. Schwartz
*Attorney, Agent, or Firm*—Jules E. Goldberg

[57] ABSTRACT

The printing sheet of the invention comprises a base sheet and two successive coating layers provided thereon, of which the first coating layer, which serves as a water-absorbing layer, is formed of a dispersion of a powdery highly water-absorptive resin, e.g., poly(-sodium acrylate), in a polymeric vehicle and the second coating layer, which serves as a water absorption-controlling layer, is formed of a dispersion of an inorganic powder such as silica in a polymeric vehicle. By virtue of the adequately controlled velocity and capacity of water absorption, the printing sheet can give a very satisfactory printed matter in respect of the color density and sharpness of the printed patterns when it is used in printing on an ink-jet printer by using an aqueous ink.

7 Claims, No Drawings

SHEET MATERIAL FOR INK-JET PRINTING

BACKGROUND OF THE INVENTION

The present invention relates to a sheet material for ink-jet printing or, more particularly, to a sheet material for ink-jet printing having greatly improved printability by virtue of a surface coating.

As is well know, many types of hard-copying apparatuses for letters including Chinese characters, graphic images and the like as well as facsimile machines, word processors, computer terminals and the like utilize an ink-jet printer as an output recording or printing machine. Ink-jet printing is a method in which a printing ink of low viscosity is pressurized and ejected from a plurality of nozzles each of a small diameter of a few tens of micrometers in the form of fine droplets having a diameter of, usually a few tens of micrometers or, in some cases, from 100 to 200 micrometers depending on the pressure, diameter of the nozzles, electric power for electrostatic charging of the droplets and so on and the desired images are formed by the impingement and pattern-wise deposition of the ink droplets, which are under control relative to occurrence and direction and velocity of flying out of the nozzles, in dots on a sheet material for ink-jet printing. Ink-jet printers are more and more widely used in recent years by virtue of the economical advantages over conventional printing methods with a quality of the printed materialst equivalent to other printing methods.

One of the problems in the ink-jet printing method is the printability of the sheet material for printing on which the ink droplets are deposited in dots. For example, the ink-jet printing is performed by using an aqueous ink so that the printing sheet having received the ink droplets deposited thereon must absorb water in the ink droplets as quickly as possible in order that the ink can rapidly permeate into the sheet. This requirement is important in order to prevent troubles in a printed matter on a poorly water-absorptive printing sheet by smearing when it is contacted with, e.g., fingers, before long after printing and stain of the contacting body as well as to prevent overspreading of the dots leading to a blurred pattern with a decrease in the color density. Accordingly, it is a conventional practice when the base material of the printing sheet having poor water-absorptivity such as a plastic film is to be used as the base sheet for a printing sheet of ink-jet printing that the surface of the sheet is coated with a coating liquid which is a dispersion of a fine powder of a highly water-absorptive resin or an inorganic water-absorptive filler in an organic resinous material as a binder or vehicle to exhibit adhesion to the surface of the base sheet. When the content of the organic binder in the coating liquid is too high relative to the water-absorptive powder, the water-absorptivity of the coating layer is poor to exhibit repellency against the ink droplets falling thereon resulting in blur of the dots or an unduly small diameter of the dots with consequently decreased effective density of the patterned images. When the content of the organic binder is too low relative to the water-absorptive powder, on the other hand, the particles of the water-absorptive powder are poorly dispersed in the binder as the vehicle sometimes to cause agglomeration so that the ink dots may have a somewhat increased diameter to decrease the resolving power of the image if not to mention the poor adhesion between the surface of the base sheet and the coating layer which is accordingly subject to falling by rubbing.

SUMMARY OF THE INVENTION

The present invention accordingly has an object to provide a novel and improved printing sheet material for ink-jet printing having greatly improved printability even when the base sheet is made of a material having no or poor water absorptivity.

Thus, the sheet material for ink-jet printing provided by the invention comprises three successive layers including:

(a) a base sheet;

(b) a first coating layer on the surface of the base sheet having a thickness in the range from 5 to 30 μm formed by coating the surface of the base sheet with a first coating liquid which is a uniform dispersion of a powder of a highly water-absorptive resin in a first organic polymer as a binder; and (c) a second coating on the first coating layer having a thickness in the range from 5 to 50 μm formed by coating the first coating layer with a second coating liquid which is a uniform dispersion of a powdery inorganic filler in a second organic polymer as a binder.

DETAILED DESCRIPTION OF THE PREFERRED EMBODIMENTS

As is described above, the inventive printing sheet material for ink-jet printing has a three-layered structure composed of (a) a base sheet, (b) a first coating layer, which serves as a water-absorbing layer, and (c) a second coating layer, which serves as a water-absorption controlling layer. When an ink droplet is deposited on the surface of the second coating layer, the ink rapidly diffuses through the second coating layer reaching the first coating layer which rapidly absorbs water in the ink so that the ink is fixed in the first layer and the surface of the printing sheet is apparently in a dry condition immediately after deposition of the ink droplets. Therefore, the printed material is freed from the troubles of smearing or stain and undue spreading of the ink dots as it is printed by ink-jet printing. Moreover, spreading of the ink dots is adequately controlled so that the ink dots may have an optimum diameter of, for example, 120 to 180 μm with a high resolving power of the printed images and improved color development as well as color density of the dots consequently to give a sharp and highly legible printing.

In the following, a detailed description is given on the inventive printing sheet material established on the above mentioned principle after extensive investigations on the types and amounts of the ingredients in the respective coating layers.

The base sheet as the substrate of the coating layers to form the inventive printing sheet can be made from a variety of materials, which may be poorly water absorptive or have no water absorptivity, without particular limitations. The materials from which the base sheet can be formed include, for example, thermoplastic resins such as polyvinyl chloride resins, polyethylenes, polypropylenes, saturated polyester resins, polycarbonate resins, acrylic resins and the like, rubbery polymers such as styrene-butadiene rubbers, nitrile rubbers, urethane rubbers, silicone rubbers, acrylic rubbers, butyl rubbers, polybutadiene rubbers and the like, metals and alloys such as aluminum, stainless steels, iron, copper, nickel, titanium, chromium and the like, ceramics in a fibrous form such as alumina, magnesia, steatite and the like, and so on. The thickness of the base sheet is usually in the range from 0.1 to 1.0 mm although the thickness should be selected depending on the desired printed material and the type of the ink-jet printing machine as a matter of course.

The surface of the above mentioned base sheet is coated with a first coating liquid which is a uniform dispersion of a powdery highly water-absorptive resin in an organic polymer as a binder. The high water-absorptivity here implied is defined by a weight proportion of water absorbed in the powdery resin in the range from 10 times to 2000 times or, preferably, from 100 times to 1000 times relative to the dry weight of the resin in a condition of equilibrium swelling at room temperature. It is also important that the absorbed water is retained in and not squeezed out of the water-swollen resin even under pressure. Examples of suitable highly water-absorptive resins include saponification products of poly(acrylic acid esters) and copolymers of vinyl acetate and acrylic acid esters, saponification products of copolymers of vinyl acetate and maleic acid, crosslinked copolymers of isobutylene and maleic anhydride, saponification products of poly(acrylonitrile), graft-copolymers of acrylonitrile on starch and saponification products thereof, and the like without particular limitations. A preferable highly water-absorptive resin is a polymer of sodium acrylate which usually absorbs 500 to 1000 times of water relative to the dry weight thereof. The powdery highly water-absorptive resin should have an average particle diameter in the range from 1 to 30 μm. When the water-absorptivity of the resin is too low, the coating layer can hardly absorb water from the droplets of the aqueous ink deposited on the printing sheet sometimes to exhibit repellency against the ink so that no satisfactory patterned images can be formed. When the water-absorptivity of the resin is too high, on the other hand, the coating layer is unduly highly swelled with the aqueous ink to result in insufficient color development.

The content of the above described highly water-absorptive resin powder in the first coating liquid, which is a uniform dispersion of the powder in an organic polymer described below as a binder, is usually in the range from 5 to 95% by weight or, preferably, in the range from 30 to 60% by weight calculated on the solid basis. When the content of the water-absorptive powder is too small, the first coating layer cannot absorb the ink only in an insufficient amount so that the ink dots formed on the printing sheet may have a decreased color density resulting in poor sharpness of the patterned images formed by the ink dots. When the content of the highly water-absorptive resin powder in the first coating liquid is too large, on the other hand, the adhesive bonding strength between the first coating layer and the surface of the base sheet as the substrate is so low as to eventually cause a trouble of falling of the coating layer.

Various kinds of organic polymers can be used to serve as a binder in which the above described highly water-absorptive resin powder is uniformly dispersed to give a first coating liquid. Examples of suitable organic polymers include thermoplastic resins such as poly(vinyl acetate), copolymers of ethylene and vinyl acetate, saturated polyester resins, polyurethanes, polyamides and the like, thermosetting resins such as epoxy resins, phenolic resins, unsaturated polyester resins, acrylic resins, polyisocyanate resins and the like and rubbery polymers such as polychloroprene rubbers, nitrile rubbers, styrene-butadiene copolymeric rubbers, silicone rubbers, natural rubber and the like. In order to obtain a uniform dispersion of the powder of the highly water-absorptive resin in the vehicle, the above mentioned organic polymers as the binder should be dissolved in a suitable solvent to have a viscosity, preferably, in the range from 100 to 5000 centistokes at room temperature. The first coating liquid can be prepared by thoroughly mixing the powder of the highly water-absorptive resin and the above described organic polymer as the binder, usually, in the form of a solution kept at room temperature. It is of course optional that this blending work is performed by heating the mixture at an elevated temperature of, for example, 40° to 70° C. in order to accelerate dispersion of the powder in the vehicle polymer. The blending work can be performed by using any known blending machines such as three-roller mills, sand grinders and the like.

It is further optional that the first coating liquid prepared by uniformly dispersing the powder of the highly water-absorptive resin in the organic polymer is admixed with the inorganic fine powder with an object to increase the water absorptivity and improve the color developability. Examples of suitable inorganic fine powders include clay, talc, calcium carbonate, aluminum hydroxide, aluminum oxide, sodium silicate, finely divided silica and the like. The above mentioned object can be achieved by adding from 50 to 200% by weight of the fine inorganic powder based on the powder of the highly water-absorptive resin so that sharply patterned images with good color development can be obtained.

The base sheet is coated with the thus prepared first coating liquid to form a first coating layer by using a suitable coating machine such as air-knife coaters, doctor coaters, roll coaters, Komma coaters and the like. The first coating layer should have a thickness in the range from 5 to 30 μm or, preferably, from 20 to 30 μm. When the thickness of the first coating layer is too small, no sufficient water-absorptivity can be exhibited. When the thickness is too large, on the other hand, the water absorptivity of the first coating layer is too large so that the ink dots may have somewhat decreased color density.

The base sheet provided with the first coating layer is then coated with a second coating liquid to form a second coating layer on the first coating layer. The second coating liquid is a uniform dispersion of an inorganic water-absorptive powder in an organic polymer as a binder. Examples of suitable inorganic water-absorptive powders capable of absorbing water by the capillary action or by other mechanisms include silica, clay, talc, calcium carbonate, calcium sulfate, titanium dioxide, aluminum silicate, calcium silicate, magnesium silicate, aluminum hydroxide and the like. The average particle diameter of these inorganic powders is in the range from 0.01 μm to 50 μm. When the average particle diameter is too small, difficulties are encountered in obtaining fine dispersion of the powder in the organic polymer as the vehicle due to agglomeration of the primary particles. When the average particle diameter of the inorganic powder is too large, on the other hand, an unduly large portion of water in the ink droplets is absorbed in the second coating layer to decrease the color density and to increase the dot diameter with consequent decrease in the resolution of the patterned images. The capacity of water absorption of these inorganic water-absorptive powders should be at least twice by weight or, preferably, twice to four times by weight based on the dry weight of the powder.

The above described water-absorptive inorganic powder is mixed with and dispersed in an organic polymer as a binder or vehicle to give a second coating liquid. Examples of suitable organic polymers as the binder include those already given as the examples of the organic polymer in the first coating liquid. In addition, the polymeric binder in the second coating liquid can be a water-soluble polymer such as oxidized starch, etherified starch, esterified starch, carboxymethyl cellulose, methyl cellulose, ethyl cellulose, hydroxyethyl cellulose, casein, gelatin, polyvinyl alcohol and the like. The formulation of the second coating liquid is that the content of the inorganic water-absorptive powder is in the range from 5 to 95% by weight or, preferably, from 30 to 60% by weight calculated on the solid basis. When the content of the inorganic powder is too low, the ink droplets deposited on the surface of the second coating layer are mostly absorbed in the first coating layer to cause a decrease in the color density. When the content of the inorganic powder in the coating liquid is too large, a decrease is caused in the adhesive bonding strength between the first and the second coating layers.

The second coating layer formed by applying the above described second coating liquid usually has a thickness in the range from 5 to 50 μm. When the thickness of the second coating layer is too small, the ink droplets deposited on the surface are rapidly absorbed in the first coating layer before each droplet is spread to form a dot having an adequately large diameter resulting in a decrease in an effective color density of the patterned images. When the thickness of the second coating layer is too large, on the other hand, overly spreading of the droplets causes running of the ink resulting in swollen ink dots with a consequent decrease in the resolution of the patterned images. It is optional that the second coating liquid is admixed according to need with various additives such as curing agents, dispersing agents, waterproofing agents, antistatic agents and the like. If necessary depending on the type of the organic polymer as the binder, it is preferably that the second coating liquid is admixed with a curing agent and the coating layer formed by applying the coating liquid to the first coating layer is heated at an elevated temperature of, for example, 60° to 150 ° .C to effect curing of the second coating layer.

As is described above, the printing sheet material of the invention for ink-jet printing is provided on the base sheet with two successive coating layers including the first coating layer containing particles of the highly water-absorptive resin to serve as a water-absorptive layer and the second coating layer containing particles of the water-absorptive inorganic powder to serve as a waterabsorption controlling layer. Therefore, the printing sheet is free from the troubles of repellency against and running of the ink droplets so that a high-quality printed matter can be easily obtained by ink-jet printing without blur and with a high resolution and high color density. The applicability of the inventive printing sheet material is not limited to the ink-jet printing but high-quality printed matters can be prepared by the methods of gravure printing, planographic printing and the like using an aqueous printing ink using the inventive printing sheet.

In the following, an example is given to illustrate the printing sheet material of the invention in more detail but not to limit the scope of the invention in any way.

EXAMPLE

A coating liquid was prepared by uniformly blending a powdery poly(sodium acrylate) resin having an average particle diameter of 10 μm and a capacity of water absorption of 1000 times by weight based on the dry weight (Sumika Gel NP-1010, a product by Sumitomo Chemical Co.) and a finely divided silica powder (Silloyd 404, a product by Fuji Davidson Co.) with a pasty resin mixture composed of 50% by weight of toluene and 50% by weight of a thermoplastic polyester resin (LP-035, a product by Nippon Synthetic Chemical Co.) at room temperature in such a proportion that the resultant coating liquid contained 50% by weight of the powdery highly water-absorptive resin and 25% by weight of the silica powder. Seven sheets of a poly(vinyl chloride) resin having a thickness of 100 μm were coated with the thus prepared coating liquid to form a first coating layer in a varied thickness in the range from 4 to 31 μm.

Another coating liquid was prepared by admixing the same silica powder as used above with a 10% by weight aqueous solution of a methyl cellulose (Metolose 60SH, a product by Shin-Etsu Chemical Co.) as a water-soluble binder in such a proportion that the content of the silica powder in the coating liquid is 10% by weight calculated on the solid basis. This second coating liquid was applied uniformly on to the surface of the first coating layer formed above on the seven base sheets to form a second coating layer having a varied thickness in the range from 4 to 51 μm. In this manner, seven coated sheets were prepared differing in the thickness of the first and second coating layers (Experiments No. 1 to No. 7) as is shown in the table given below.

For comparison, another coated sheet was prepared (Experiment No. 8) by providing the same poly(vinyl chloride) resin sheet as above with a single coating layer alone in a thickness of 30 μm by using a coating liquid which was a dispersion containing 75% by weight of the same silica powder as used above in the same pasty resin mixture of the thermoplastic polyester resin as used in the first coating liquid above.

Each of the thus prepared eight coated sheets were subjected to the test of printability using a black aqueous ink on a jet-printing machine (Model #725, manufactured by Sharp Co.) for three items including the diameter of the ink dots in μm, color density of the dots and velocity of ink absorption each defined as follows to give the results shown in the table below.

The diameter of the ink dots given in the table was an average of the values obtained by the microscopic measurement for 10 dots. The color density was measured by using a densitometer (Sakura Densitometer Model PDA-45). The velocity of ink absorption was the time in seconds taken for complete disappearance of free ink liquid when an ink droplet of 0.0006 ml volume was put on the printing sheet.

As is understood from the results shown in the table, no sufficiently high velocity of ink absorption could be obtained when the first coating layer had a small thickness or was omitted resulting in an increase in the diameter of the dots (Experiments No. 4 and No. 8). When the thickness of the first coating layer was large, on the other hand, the color density was decreased due to the excessively high water absorptivity (Experiment No. 5). When the thickness of the second coating layer was small, the diameter of dots was decreased consequently with a decrease in the color density (Experiment No. 6).

When the thickness of the second coating layer was large, on the other hand, the diameter of the dots was increased due to running of the ink (Experiment No. 7).

TABLE

| Experiment No. | Thickness of first coating layer, μm | Thickness of second coating layer, μm | Diameter of dots, μm | Color density | Velocity of ink absorption, seconds |
|---|---|---|---|---|---|
| 1 | 10 | 10 | 180 | 1.70 | 1.0 |
| 2 | 15 | 30 | 150 | 1.50 | 0.5 |
| 3 | 25 | 40 | 140 | 1.20 | >0.5 |
| 4 | 4 | 20 | 220 | 1.80 | 2.5 |
| 5 | 31 | 20 | 80 | 0.70 | >0.5 |
| 6 | 10 | 4 | 90 | 0.90 | >0.5 |
| 7 | 10 | 51 | 230 | 1.80 | 0.5 |
| 8 | 0 | 30 | 280 | 2.00 | 3.0 |

What is claimed is:

1. A sheet metal for ink-jet printing which comprises three successive layers including:

(a) a base sheet;

(b) a first coating layer on the surface of the base sheet having a thickness in the range from 5 to 30 μm formed by coating the surface of the base sheet with a first coating liquid which is a uniform dispersion of a powder of a highly water-absorptive resin capable of absorbing water in an amount of 10 to 2000 times by weight based on the dry weight thereof in a first organic polymer as a binder, the powder of the highly water-absorptive resin having an average particle diameter in the range from 0.1 to 30 μm, and (c) a second coating layer on the first coating layer having a thickness in the range from 5 to 50 μm formed by coating the first coating layer with a second coating liquid which is a uniform dispersion of a powdery water-absorptive inorganic filler having an average particle diameter in the range from 0.01 to 50 μm and a water absorption of at least 2 x by weight of the dry weight of the powder in a second organic polymer as a binder.

2. The sheet material for ink-jet printing as claimed in claim 1, wherein the highly water-absorptive resin in the first coating liquid is selected from the group consisting of polymers of sodium acrylate, saponification products of poly(acrylic acid esters) and copolymers of vinyl acetate and acrylic acid esters, saponification products of copolymers of vinyl acetate and maleic acid, crosslinked copolymers of isobutylene and maleic anhydride, saponification products of poly(acrylonitrile) and graft-copolymers of acrylonitrile on starch and saponification products thereof.

3. The sheet material for ink-jet printing as claimed in claim 1, wherein the powdery inorganic filler in the second coating liquid is selected from the group consisting of silica, clay, talc, calcium carbonate, calcium sulfate, titanium dioxide, aluminum silicate, calcium silicate, magnesium silicate and aluminum hydroxide.

4. The sheet material for ink-jet printing as claimed in claim 1, wherein the organic polymer in the first coating liquid is selected from the group consisting of poly(vinyl acetate), copolymers of ethylene and vinyl acetate, saturated polyester resins, polyurethanes, polyamides, epoxy resins, phenolic resins, unsaturated polyester resins, acrylic resins, polyisocyanate resins, polychloroprene rubbers, nitrile rubbers, styrene-butadiene copolymeric rubbers, silicone rubbers and natural rubber.

5. The sheet material for ink-jet printing as claimed in claim 1, wherein the organic polymer in the second coating liquid is selected from the group consisting of poly(vinyl acetate), copolymers of ethylene and vinyl acetate, saturated polyester resins, polyurethanes, polyamides, epoxy resins, phenolic resins, unsaturated polyester resins, acrylic resins, polyisocyanate resins, polychloroprene rubbers, nitrile rubbers, styrene-butadiene copolymeric rubbers, silicone rubbers, natural rubber, oxidized starch, etherified starch, esterified starch, carboxymethyl cellulose, methyl cellulose, ethyl cellulose, hydroxyethyl cellulose, casein, gelatin and polyvinyl alcohol.

6. The sheet material for ink-jet printing as claimed in claim 1, wherein the first coating liquid contains the powder of the highly water-absorptive resin and the organic polymer as a binder in a weight proportion in the range from 5:95 to 95:5.

7. The sheet material for ink-jet printing as claimed in claim 1, wherein the second coating liquid contains the powdery inorganic filler and the organic polymer as a binder in a weight proportion in the range from 5:95 to 95:5.

* * * * *